US005378411A

United States Patent [19]

Iwaki et al.

[11] Patent Number: 5,378,411

[45] Date of Patent: Jan. 3, 1995

[54] AUTOMATIC CHOKE SYSTEM FOR CARBURETOR

[75] Inventors: Takahiro Iwaki; Michihiro Suda, both of Tokyo, Japan

[73] Assignee: Nippon Thermostat Co., Ltd., Tokyo, Japan

[21] Appl. No.: 163,795

[22] Filed: Dec. 9, 1993

[30] Foreign Application Priority Data

Oct. 8, 1993 [JP] Japan ..... 5-253360

[51] Int. Cl.[6] ..... F02M 1/06

[52] U.S. Cl. ..... 261/39.2; 261/DIG. 8; 261/44.3

[58] Field of Search ..... 261/39.2, DIG. 8, 44.3

[56] References Cited

U.S. PATENT DOCUMENTS 3,613,650 10/1971 Stumpp ..... 261/39.2
4,292,258 9/1981 Sakurai et al. ..... 261/39.2

FOREIGN PATENT DOCUMENTS 0117973 5/1989 Japan ..... 261/DIG. 8
620729 3/1949 United Kingdom ..... 261/39.2

*Primary Examiner*—Tim Miles
*Attorney, Agent, or Firm*—Longacre & White

[57] ABSTRACT

The present disclosure concerns an automatic choke system designed to make a whole carburetor shorter and more compact. The system comprises a case body having a generally inverted L-shape, with a thermo-element housed in a vertical portion of the case body. A thermistor proximate to thermally expanding wax inside the thermo-element is heated up by electric current, which increases its own electric resistance with the increasing heat. A piston is projected from the top end of the thermo-element by the thermal expansion of the wax. A link housed in the horizontal portion of the case body is pivotally supported therein so as to move a moving part downward when the link is acted on by the piston. The moving part pushes down a starter valve to close a by-pass passageway as well as push down a needle to close an auxiliary fuel passageway.

8 Claims, 10 Drawing Sheets

AUTOMATIC CHOKE SYSTEM FOR CARBURETOR

BACKGROUND OF THE INVENTION a) Field of the Invention

The invention concerns an automatic choke system for carburetors provided on engines installed in motorcycles, motor scooters, etc.

b) Description of Related Art

A conventional automatic choke system for a carburetor installed on an engine, as is widely known, increases the fuel-to-air ratio at low engine operating temperatures in order to ease starting the engine smoothly. Subsequently, the choke system automatically returns; the fuel-to-air ratio to normal (as specified), and establishes the proper rate of engine rotation upon a corresponding rise in the operating temperature of the engine.

Specifically, a throttle valve in the carburetor is regulated by an accelerator pedal, etc. to control the flow of fuel/air mixture in a main air passageway. A starter valve provided in a passageway by-passing the main air passageway and a needle provided in an auxiliary fuel passageway connected with the by-pass passageway are opened automatically at low temperatures of the engine, thereby providing an increased fuel-to-air ratio.

When the engine reaches a predetermined operating temperature, the starter valve closes the by-pass passageway and the needle also closes the auxiliary fuel passageway, automatically returning the fuel-to-air ratio to normal and establishing the proper rate of engine revolution.

FIG. 7 shows a conventional carburetor with a main body 20 comprising a main air passageway 21, a by-pass passageway 22 by-passing the main air passageway 21, and an auxiliary fuel passageway 24 connected with the by-pass passageway 22. A throttle valve 23 is provided in the main air passageway 21. A starter valve 25 and a needle 26 form the automatic choke system 34 for automatically opening the by-pass passageway 22 and auxiliary fuel passageway 24 when the engine is at low operating temperatures, and closing these when the temperature is elevated.

The FIG. 7 does not show a main fuel passageway connected to the main air passageway 21, however, this is well known in the prior art.

The starter valve 25 and needle 26 are mounted on the tip end of a moving part 28. The moving part 28 is pushed by piston **27*a* of a thermo-element 27 and a return spring 30 pushes back on the moving part 28. The thermo-element 27, piston 27*a* and the moving part 28 are housed in a case 29. A thermistor 31 is adhered to the thermally expanding wax side of the thermo-element 27, as set out hereunder, to limit an electric current with an increase in the electric resistance due to the heat generated by the electric current. Wiring 32 links the thermistor 31 with a connector 33** for further connection with an electric circuit (not shown).

FIG. 8 is a cutaway detail drawing of the thermo-element 27 including thermally expanding and contracting wax **27*b* made from paraffine and copper powder housed in a case 27*c*. A guide tube 27*f* is coupled to the opening of the case 27*c* and houses a fluid 27*e*. The thermal wax 27*b* and the fluid 27*e* are contained and separated from one another by means of a diaphragm 27*d* made from nitrile rubber, etc. A piston 27*a* is movably inserted into guide tube 27*f* with a gasket 27*g* provided between the guide tube 27*f* and the piston 27*a*. A back-up ring 27*h* is surrounded by the gasket 27*g*, the guide tube 27*f* and the piston 27*a*. Bushings 27*i* are provided between the guide tube 27*f* and the piston 27*a* to guide movement of the piston 27*a***.

FIG. 9 is a side view showing the automatic choke system 34 installed on the top surface **20*a* of the carburetor main body 20. Thermally insulating cover 40 is provide over the automatic choke system 34. FIG. 10 is a partial side view of a motorcycle or a motor-scooter 35 with an engine 36 on which a carburetor main body 20 equipped with the automatic choke system 34 is installed. An air cleaner 37 is also installed on the main body 20** of the carburetor.

The conventional automatic choke system 34 is arranged, in linear sequential order, with the needle 26, the starter valve 25, the moving part 28, the thermo-element 27 and the thermistor 31, all housed in the case 29. As shown in FIG. 9, the automatic choke system 34 is substantially elongated and is mounted on the top surface **20*a* of the carburetor main body 20 with the thermally insulating cover 40 covering the top of the automatic choke system 34**.

One problem with conventional arrangements is that a relatively extensive space must be secured above the carburetor main body 20. In addition, when the engine 36 is equipped with the elongated automatic choke system 34 underneath seat 38, the compartment 39 of the motorcycle or motor-scooter 35 cannot be used for storing a helmet or anything else because the tall automatic choke system 34 restricts the size of the compartment 39. Further, since it was not previously known to make a carburetor main body 20 equipped with an automatic choke system 34 into a more compact unit, the freedom to design a more compact motorcycle or motor-scooter 35 was substantially limited.

Another problem encountered in conventional systems is that if the thermal insulation of the thermo-element 27 for the automatic choke system 34 is poor, the thermally expanding wax **27*b* in the thermo-element 27 remains contracted. The starter valve 25 and the needle 26 of the automatic choke system 34 also respectively keep the by-pass passageway 22 and the auxiliary fuel passageway 24** open, hence the engine cannot be easily restarted a few minutes after the engine is turned off, but is still warm.

SUMMARY OF THE INVENTION

An objective of the present invention is to provide an automatic choke system 1 for a carburetor as described with respect to FIGS. 1–3. A case main body 2 has an inverted L-shape with a thermo-element 3 housed in the vertical portion **2*a* of the case main body 2. A thermistor 4 is adhered to a lower end of the thermo-element 3, proximate to thermally expanding wax 3*a*. Thermistor 4 limits electric current with the increase in electric resistance due to heat generated by the electric current. A piston 3*b* projects from an opposite, upper end of the thermo-element 3 upon thermal expansion of the wax 3*a*. A link 6 housed in a horizontal portion 2*b* of the case main body 2 is pushed up at one end 6*a* by the piston 3*b*, and a moving part 7 is correspondingly pushed down by the other end 6*b* of the link 6. A starter valve 10 is inserted through an upper face 9*a* of a carburetor 9 into a by-pass passageway 8 connected with a main air passageway (not shown) of the carburetor 9. The starter valve 10 shuts off the by-pass passageway 8** by lowering the moving part 7, and shuts off an auxiliary fuel passageway 11 by lowering a needle 12.

The automatic choke system 1 described above operates as follows when starting an engine having a carburetor 9 according to the present invention. Initially, the throttle valve (not shown) provided in the main air passageway (not shown) is closed and the thermally expanding wax 3*a* is contracted. Consequently, the piston 3*b* of the thermo-element 3 is retracted along with the end 6*a* of the link 6, whereupon the other end 3*b* is pivoted to withdraw the starter valve 10 from the by-pass passageway 8 as well as withdraw the needle 12 from the auxiliary fuel passageway 11. Hence, starting the engine is eased by providing additional air and fuel from the by-pass passageway 8 and auxiliary fuel passageway 11, respectively, which is not regulated by the throttle valve provided in the main air passageway.

To start the engine, a key-switch (not shown) turns ON the thermistor 4 attached to the thermally expanding wax 3*a*. Heat from the thermistor 4 expands the wax 3*a* pushing the piston 3*b* out from the top end of the thermo-element 3. The action of the piston 3*b* on the end 6*a* of the link 6 causes the other end 6*b* to push down the moving part 7. The by-pass passageway 8 is closed by means of the starter valve 10 being acted on by the moving part 7. Similarly, the needle 12 closes the auxiliary fuel passageway 11 automatically returning the fuel-to-air ratio to normal and establishing the proper engine rate of revolution for an idling condition. By the time the engine reaches the idling condition, electric resistance of the thermistor 4 has increased in proportion to the heat of the thermistor 4, and as a result, the electric current to the thermistor 4 is substantially reduced or shut off.

This invention is intended to make it possible to conserve space above the main body of a carburetor by installing an automatic choke system according to the present invention. This is accomplished with an automatic choke system having an inverted L-shape case configured with the vertical portion on a side of the carburetor. As a result, only the horizontal portion of the case projects above the top of the carburetor and the height of the whole carburetor is minimized.

Accordingly, a larger compartment underneath the seat of the motorcycle or motor-scooter may be obtained (for a helmet, etc.), as well as greater freedom in designing a compact motorcycle or motor-scooter.

In addition, improved thermal insulation is provided for the thermo-element of the automatic choke system according to the present invention. A problem of conventional automatic choke systems is difficulty re-starting the engine, when it is still warm, because the thermally expending wax of the thermo-element remains contracted. Consequently, the starter valve and the needle keep the by-pass and the auxiliary fuel passageways open even a few minutes after the engine is turned off, but is still warm.

In yet another aspect of the automatic choke system according to the present invention, the relationship between the upward stroke of the piston 3*b* of the thermo-element 3 and the downward stroke of the moving part 7 may be either linear or non-linear. Further, the ratio of the upward stroke of the piston to the downward stroke of the moving part may be changed, hence the automatic choke system may be optimized to further ease starting the engine.

DESCRIPTION OF THE PREFERRED EMBODIMENT

Figure 1:
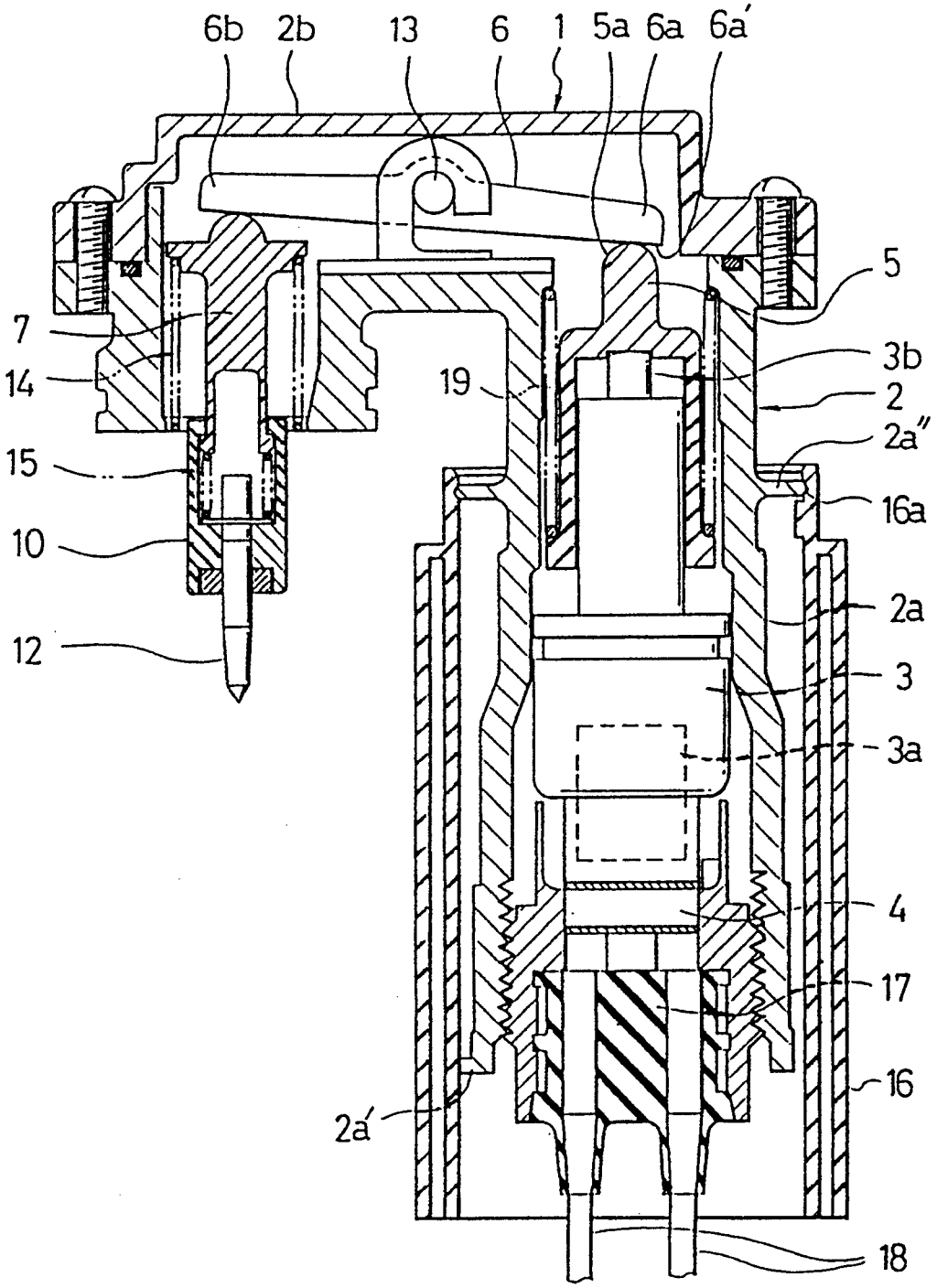
FIG. 1 is a sectional drawing of the automatic choke system according to the present invention.
Figure 2:
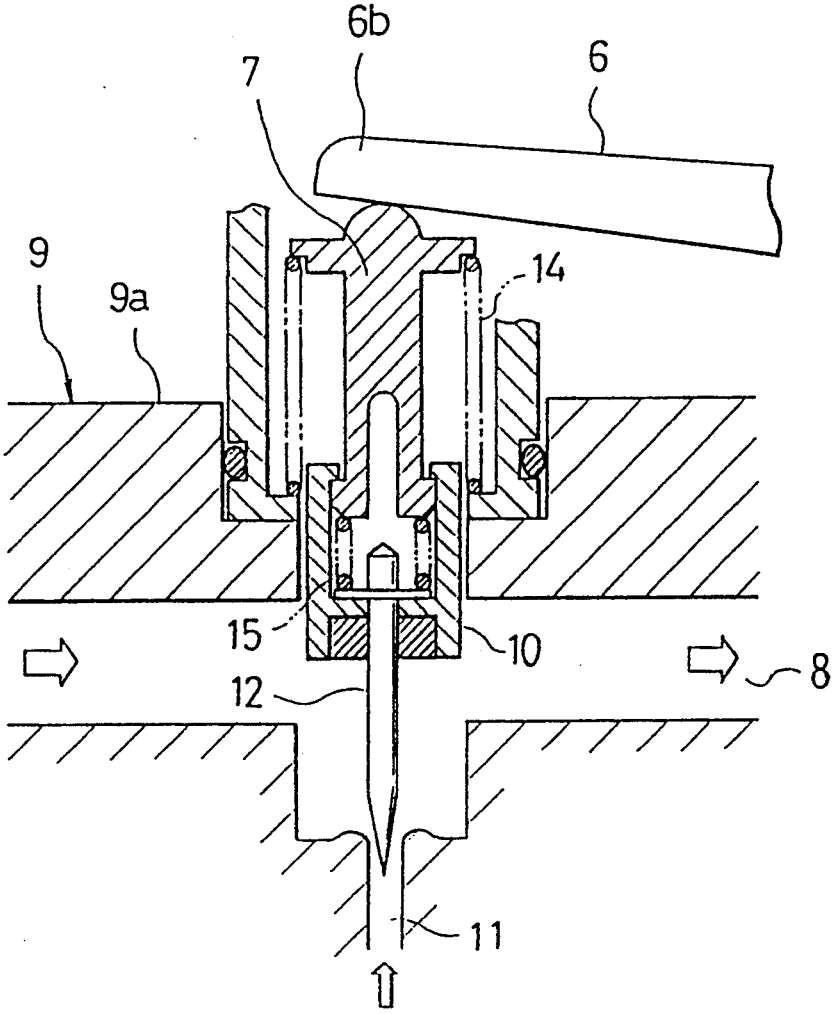
FIG. 2 is a sectional drawing showing the condition of the automatic choke system according to the present invention prior to operation.
Figure 3:
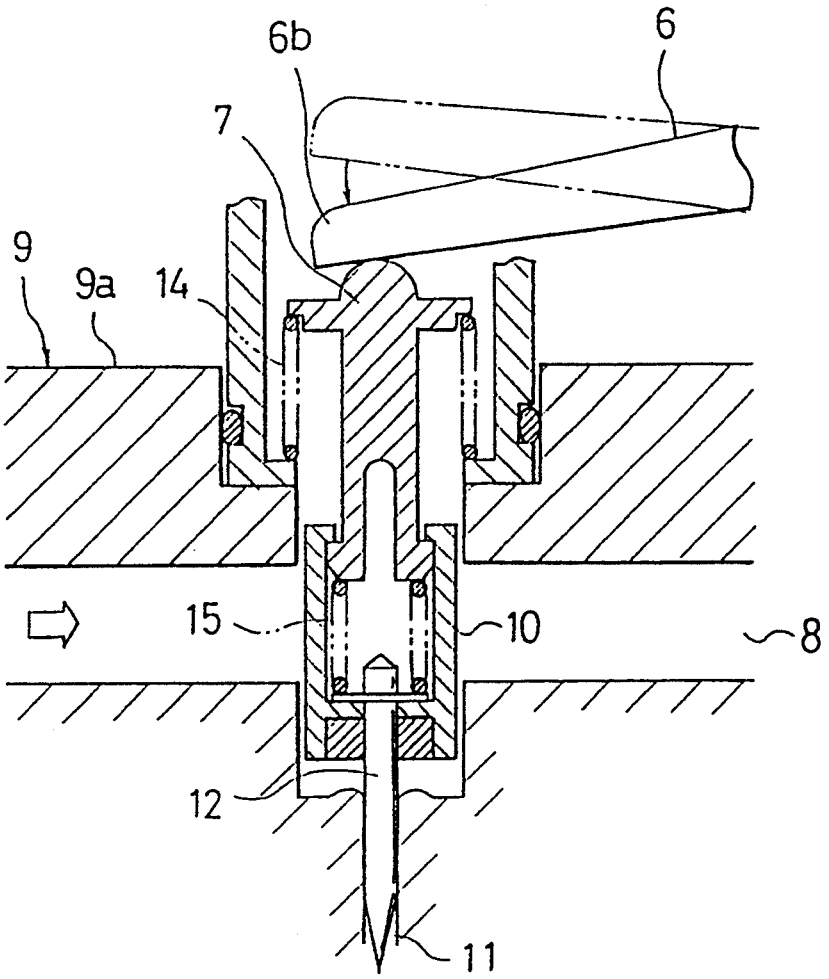
FIG. 3 is a sectional drawing showing the condition of the automatic choke system according to the present invention after operation.

The preferred embodiments of this invention are described hereunder with reference to the accompanying drawings.

A case body 2 is made in an inverted L-shape from, for instance, plastics. A thermo-element 3 is housed in a vertical portion 2*a* of the case body 2 with a thermistor 4 adhered to the lower end of the thermo-element 3, i.e. proximate to thermally expanding wax 3*a*. Thermistor 4 is heated by electric current which increases its own electric resistance which shuts off the electric current. A first moving part 5 is pushed upward by a piston 3*b* projected from the top end of the thermo-element 3 due to thermal expansion of the wax 3*a*. A link 6 is housed in the horizontal portion 2*b* of the case 2 and is pivoted by virtue of one end 6*a* being pushed up by the first moving part 5 whereupon the other end 6*b* is pushed down. The second moving part 7 is moved downward by the other end 6*b* of the link 6. A by-pass passageway 8 is connected with the main air passageway (not shown) of a carburetor 9. A starter valve 10 is provided at the lower end of the second moving part 7 and is inserted into the by-pass 8 through the top end 9*a* of the carburetor 9 so as to shut off the by-pass passageway 8 with the downward movement of the second moving part 7. Similarly, needle 12 closes an auxiliary fuel passageway 11 connected with the by-pass passageway 8.

Link 6 is pivotally supported by supporting shaft 13. By changing the position of the supporting shaft 13 with respect to the link 6, the ratio between the upward moving stroke of the first moving part 5 and the downward moving stroke of the second moving part 7 may be regulated.

In addition, by changing the relative shape of the upper surface 5*a* of the first moving part 5 and the lower surface 6*a*′ of the one end 6*a* (or by changing the relative shape of the lower surface of the other end 6*b* and the upper surface of the second moving part 7), the relationship between the upward moving stroke of the first moving part 5 and the downward moving stroke of the second moving part 7 may be either linear or non-linear.

The aforementioned motion of the second moving part 7 is opposed by means of a spring 14 supported by the case body 2. Both the starter valve 10 and the needle 12 are pushed down by the second moving part 7 via a spring 15. A thermally insulated cover 16 may be made from plastics molded as a mono-block on the outer surface of the vertical portion 2*a* of the case body 2, or separately provided as set out hereunder. In the case that the thermally insulated cover 16 is provided separately, the cover 16 is formed with a plurality of spaced circumferential walls. A concave groove 16*a* is formed on an upper, inner surface of the cover 16 for mating with an annular salient 2″ provided at an upper, outer surface of the vertical portion 2*a* of the case body 2. A plurality of convex salient 2*a*′ are also formed at a lower, outer surface of the vertical portion 2*a* of the case body 2. Such an installation provides a space between the inner circumference of the thermally insulated cover 16 and the outer circumference of the case body 2. As a result, improved thermal insulation is provided to the thermal-element of the automatic choke system. A mono-block molding of the thermally insulated cover 16 with the vertical part 2*a* of the case body 2 is possible as well.

The reason for installing the thermally insulated cover 16 is, as discussed above, to overcome the problem caused when an engine having a poorly insulated thermo-element 3 of the automatic choke system 1 is turned off. The engine may not be re-started easily, while the engine is still warm, for a few minutes after being turned OFF because the wax of the thermal-element 3 contracts to open the by-pass passage 8 and the auxiliary fuel passageway 11.

A rubber 17 provides vibration damping, as well as insulating and dust proofing the wiring cord 18 connected with the thermistor 4. A spring 19 is provided for counteracting the motion of the piston 3*b* on the first moving part 5.

Figure 4:
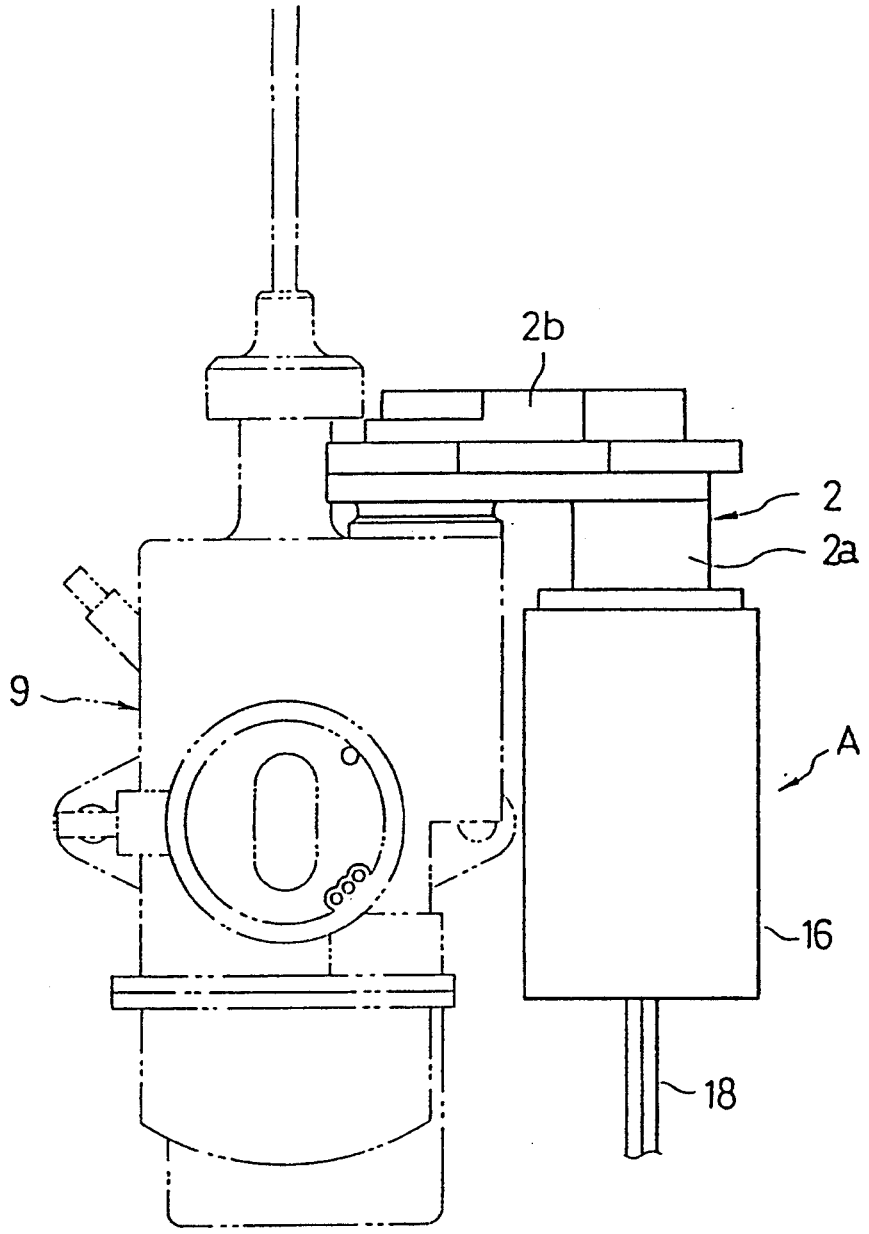
FIG. 4 is a front elevation showing a carburetor equipped with the automatic choke system according to the present invention.
Figure 5:
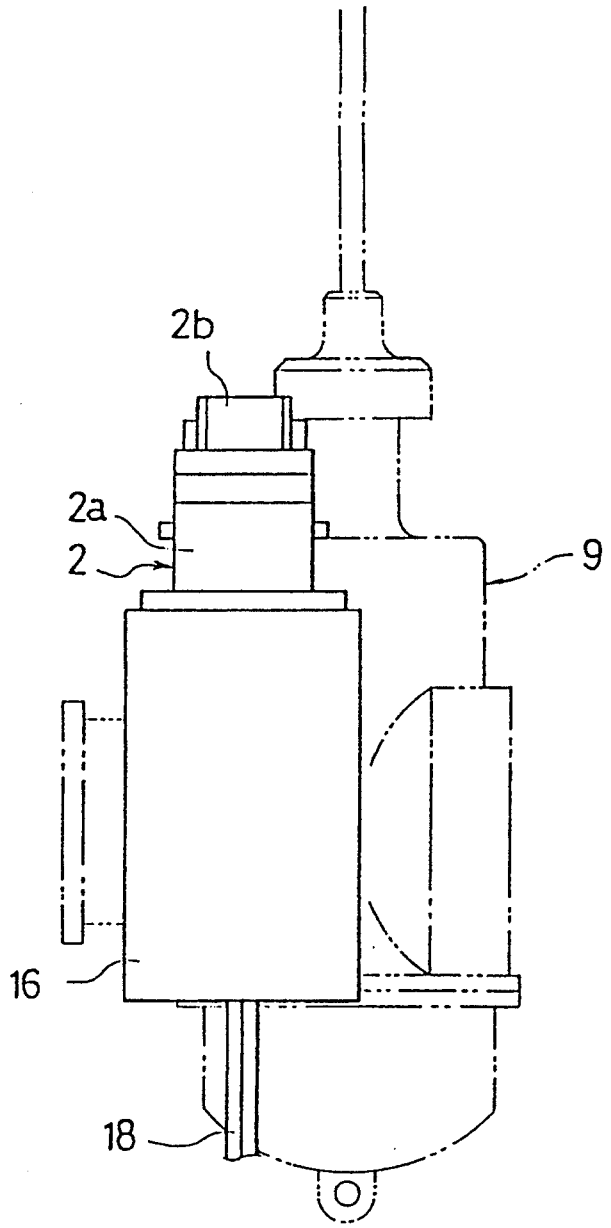
FIG. 5 is a side elevation looking in a direction indicated by arrow A in FIG. 4.
Figure 6:
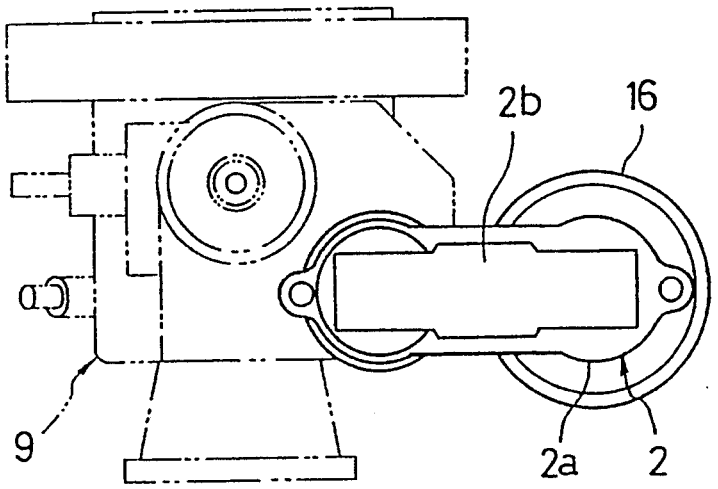
FIG. 6 is a plan drawing showing a carburetor equipped with the automatic choke system according to the present invention.
Figure 7:
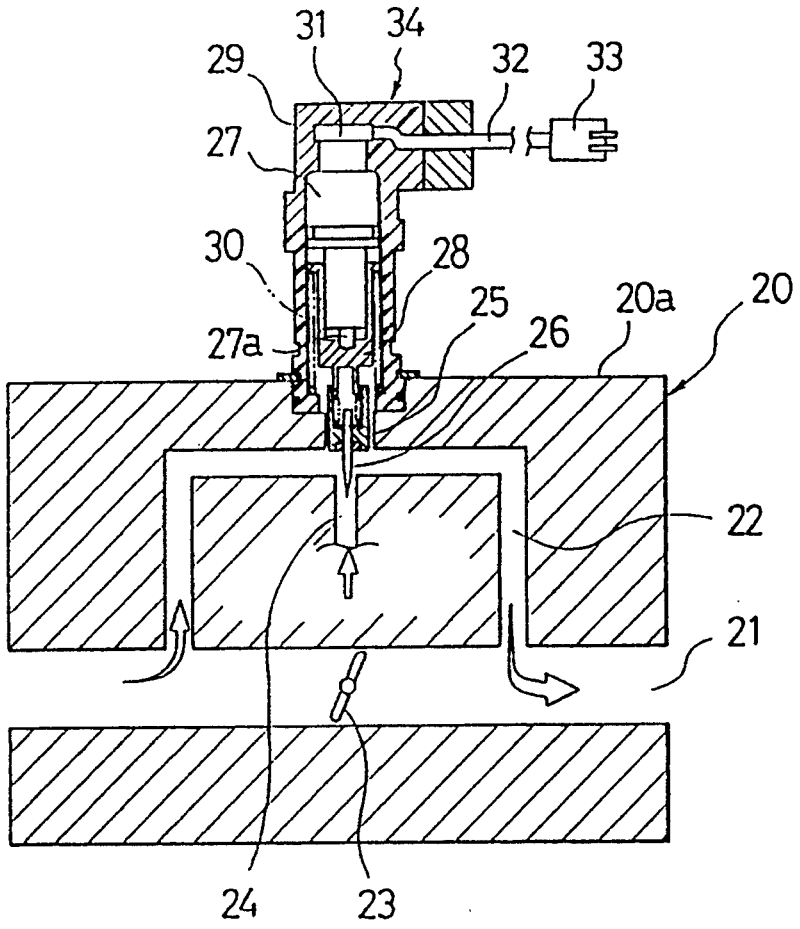
FIG. 7 is a sectional drawing of a conventional automatic choke system.
Figure 8:
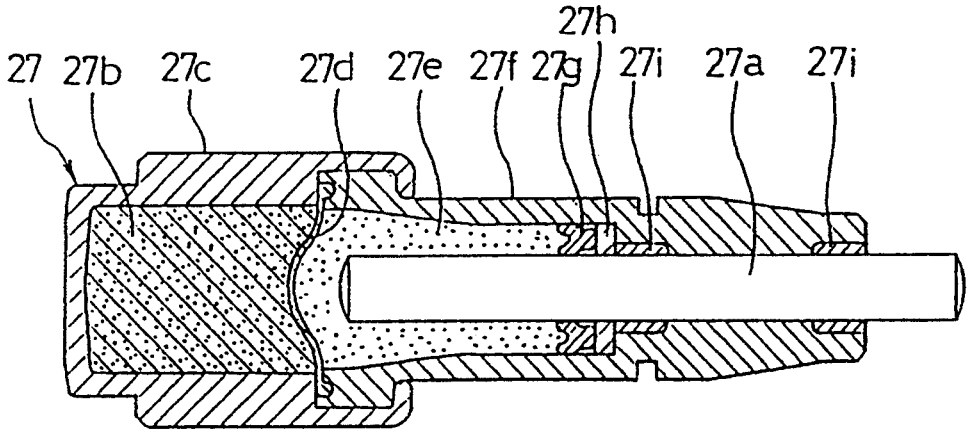
FIG. 8 is a sectional drawing showing a thermo-element in detail.
Figure 9:
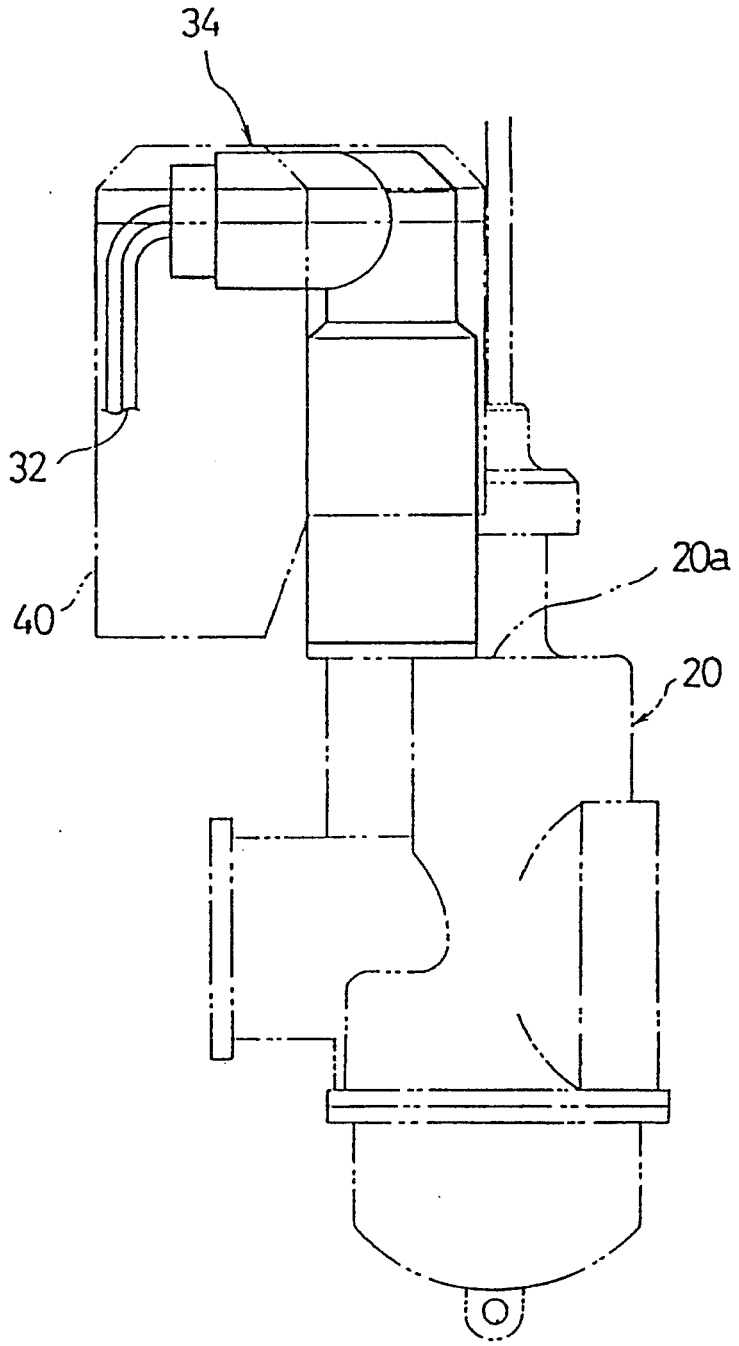
FIG. 9 Is a side elevation of a carburetor equipped with a conventional automatic choke system.
Figure 10:
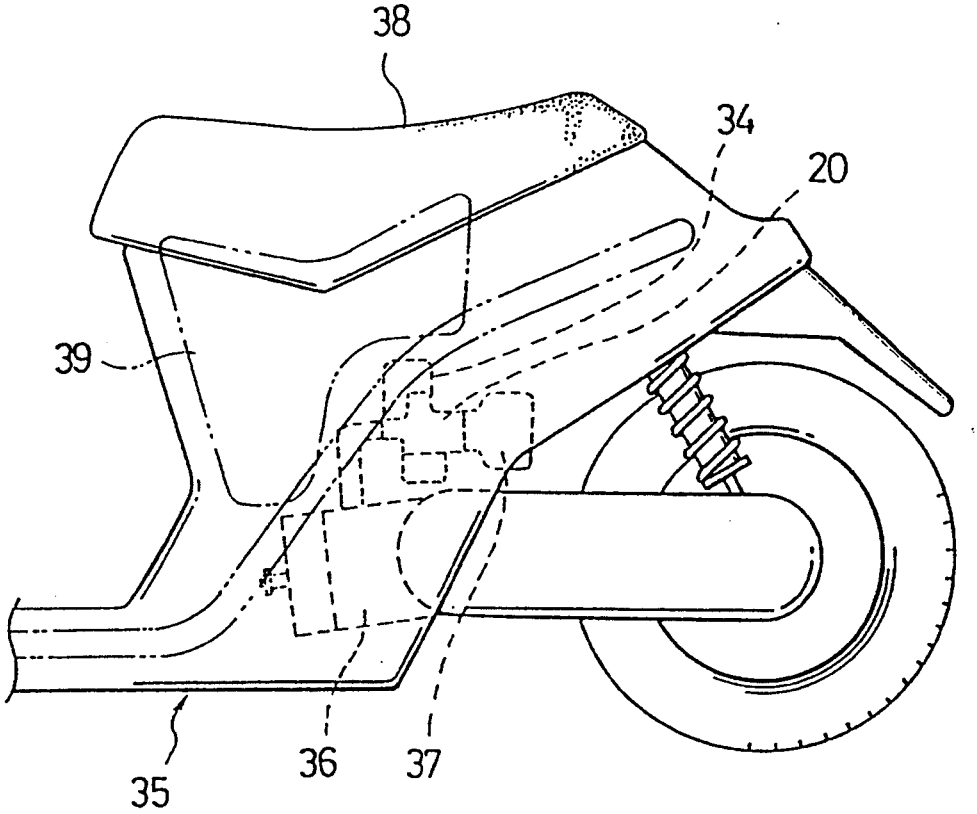
FIG. 10 is a side elevation showing a motorcycle or motor-scooter on which a carburetor equipped with a conventional automatic choke system is mounted.

FIGS. 4–6 in particular show the vertical portion 2*a* of the case body 2 is positioned by the side of carburetor 9. As a result, the portion of the automatic choke system 1 projecting above the top of the carburetor is minimized to make the carburetor 9 equipped with the automatic choke system 1 more compact in size.

The design also gives better thermal insulation to the thermo-element of the automatic choking system 1 and the thermally insulated cover 16 may be molded into a mono-block with the vertical portion 2*a* of the case body 2. Ample space is generally available around the sides of the carburetor for the installation of the automatic choke system 1. Further, the relative position of the vertical portion 2*a* with respect to the case body 2 may be easily adjusted on the side of the carburetor.

Inasmuch as the wiring cord 18 connected with the thermo-element extends from the lower end of the vertical portion 2*a*, the wiring cord 18 may be shortened to eliminate interference with peripheral parts.

It is to be understood that this invention is not limited to the above description and the appended drawings, but rather various changes and modifications may be made without departing from the spirit and scope of the invention.

What is claimed is:

1. An automatic choking system for a carburetor comprising:

a case body having a generally inverted L-shape;

a thermo-element housed in an elongated vertical portion of the case body, the vertical portion having a first end and a second end opposite the first end;

a thermistor proximate to thermally expanding wax provided in the first end of the thermo-element, wherein the thermistor is heated by electric current which increases electric resistance of the thermistor which shuts off the electric current;

a piston projected from the second end of the thermo-element by thermal expansion of the wax;

a link housed in a horizontal portion of the case body and pivotally supported so that one terminus of the link is pushed down by the piston pushing up on a second terminus of the link;

a moving part pushed downward by the second terminus of the link;

a starter valve extending downward into a by-pass passageway to shut off the by-pass passageway as a consequence of the moving part being moved downward by the link, the by-pass passageway by-passes a main air passageway of the carburetor; and a needle to shut off an auxiliary fuel passageway.

2. The automatic choke system for the carburetor according to claim 1, wherein a thermally insulated cover is provided over an outer surface of the vertical portion of the case body.

3. The automatic choke system for the carburetor according to claim 2, wherein the thermally insulated cover is a mono-block molding including the case body.

4. The automatic choke system for the carburetor according to claim 2, wherein the thermally insulated cover is a separate mono-block molding from the case body.

5. The automatic choke system for the carburetor according to claim 2, wherein the thermally insulated cover includes a plurality of spaced circumferential walls.

6. The automatic choke system for the carburetor according to claim 5, wherein a concave groove is formed on an upper inner surface of the cover and a cooperatively mating annular salient is formed on an upper outer surface of the vertical portion of the base body, and a plurality of convex salients are formed on a lower outer surface of the vertical portion of the case body, whereby the thermally insulated cover is pulled up from the lower outer surface to cover the upper outer surface.

7. The automatic choke system for the carburetor according to claim 1, wherein the relationship between an upward moving stroke of the piston and a downward moving stroke of the moving part may be changed from linear to non-linear by changing the shape of at least one contact surface between the link with the piston and the link with the moving part.

8. The automatic choke system for the carburetor according to claim 1, wherein a ratio between an upward moving stroke of the piston and a downward moving stroke of the moving part is varied by changing the position about which the link is pivotally supported.

* * * * *